US011554889B2

(12) United States Patent
Guerrero

(10) Patent No.: US 11,554,889 B2
(45) Date of Patent: Jan. 17, 2023

(54) LABEL FLAGGER

(71) Applicant: Brady Worldwide, Inc., Milwaukee, WI (US)

(72) Inventor: Moises Guerrero, Milwaukee, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 61 days.

(21) Appl. No.: 16/577,825

(22) Filed: Sep. 20, 2019

(65) Prior Publication Data

US 2021/0086937 A1 Mar. 25, 2021

(51) Int. Cl.
*B65C 3/02* (2006.01)
*B65C 9/46* (2006.01)
*B65C 9/18* (2006.01)

(52) U.S. Cl.
CPC ..... *B65C 3/02* (2013.01); *B65C 9/18* (2013.01); *B65C 9/46* (2013.01)

(58) Field of Classification Search
CPC .... B65C 3/02; B65C 3/04; B65C 9/18; B65C 9/30; B65C 9/32; B65C 9/34; B65C 9/36; B65C 9/46; B65B 13/182
See application file for complete search history.

(56) References Cited

U.S. PATENT DOCUMENTS 2,873,564 A * 2/1959 Bogeskov ..... B65C 3/02 53/399
3,192,093 A 6/1965 Tobey
3,658,630 A * 4/1972 Stauber ..... B65C 3/16 156/566
4,643,786 A 2/1987 Cecchi
7,178,572 B2 2/2007 Schanke
2002/0084020 A1* 7/2002 Scott ..... B65C 3/02 156/215
2004/0206459 A1 10/2004 Schanke
2004/0206460 A1* 10/2004 Schanke ..... B65C 9/1865 156/443

(Continued)

FOREIGN PATENT DOCUMENTS

CN 102717943 B 7/2013
CN 103395527 B 1/2015

(Continued)

OTHER PUBLICATIONS

International Searching Authority. International Search Report and Written Opinion for application PCT/US2020/051064. dated Dec. 15, 2020. 7 pages.

*Primary Examiner* — George R Koch
(74) *Attorney, Agent, or Firm* — Quarles & Brady LLP

(57) ABSTRACT

Systems and methods include an assembly for a label wrapper to adhere a label to an elongated object, such as a wire. The assembly includes a support structure defining a receiving space. One or more resilient members are positioned within the receiving space and define one or more channels. One or more flexible sheets are disposed over the resilient members and within the channels. The first and second flexible sheets may provide a substantially uniform pressure on the label being applied to the wire regardless of the size of the wire and the label. In some instances, the label is configured to fold around the wire and have first and second opposing end segments that couple with one another remotely from the wire thereby forming a flag label.

20 Claims, 10 Drawing Sheets

(56) References Cited

U.S. PATENT DOCUMENTS

| | | | | |
|---|---|---|---|---|
| 2004/0211522 | A1* | 10/2004 | Fries | B65C 3/02<br>156/443 |
| 2015/0068658 | A1* | 3/2015 | Merrill | B65C 3/16<br>156/60 |

FOREIGN PATENT DOCUMENTS

| | | | |
|---|---|---|---|
| CN | 107405933 | A | 11/2017 |
| CN | 206939245 | U | 1/2018 |
| CZ | 27547 | U1 | 12/2014 |
| JP | 2016170623 | A | 9/2016 |

* cited by examiner

LABEL FLAGGER

CROSS-REFERENCE TO RELATED APPLICATION

Not applicable.

FIELD OF INVENTION

This disclosure relates to label wrappers, and more particularly to a label wrapper attachment assembly that applies a label to elongated objects.

BACKGROUND

Printers, such as thermal transfer label printers, are often used for printing various labels. In various thermal transfer label printers, a label and a thermal transfer printer ribbon are compressed between a print head and a roller and fed together past the print head. The print head produces sufficient heat in the appropriate locations to transfer the ink from the ribbon to the label to print a label.

The labels produced by the printer are often then applied to the wires being labeled by hand. In various applications, industry or customer specifications may dictate a type of label that can be applied. For example, the label may be a heat-shrink tubing label, a material configured to wrap around an object, a self-laminating label, a flag label, and/or a non-adhesive label. Applying a label to a wire by hand has many drawbacks. No matter the type of label, attempting to apply labels to wires—especially small diameter wires—is time consuming, inaccurate in that it is difficult to place the labels in such a way that the labels are square and aligned on the wire, and inefficient in that it is difficult to properly and evenly secure the label to the surface of the wire.

Label application mechanisms are available that automatically apply tape and preprinted labels to cylindrical objects, such as bottles, cans, and the like. These systems typically require the object being labeled to be conveyed past the applicator mechanism in order for the mechanism to apply a preprinted label. A finishing device can then press the label to the object. However, these systems are designed to be used with large diameter cylindrical objects such as cans or bottles and none of these systems can be used or be easily adapted to be used with elongated, flexible objects of a small diameter such as wires, wire bundles, and non-cylindrical objects. Additionally, label application mechanisms are usually very large and adjustments take a significant amount of time.

Moreover, the application of a flag label onto a cylindrical object having a relatively small diameter, such as a wire, presents a host of additional problems. For example, when applying a flag label to an object, the label can stick to the label applicator as it is pressed against the object or the label may be misaligned. Further, it is difficult to uniformly press a label against the object to avoid bubbles and ensure that opposing sides of the label are uniformly aligned with one another.

Therefore, a need exists for a device that can securely and uniformly apply a flag label, and many other types of labels, to a relatively small diameter object.

SUMMARY

Conventional approaches such as those described above have disadvantages, particularly in the electrical field. The wrapping of labels onto wires may be tedious and lead to many imperfections, such as misalignment. In addition, the misalignment may allow an adhesive on the label to attach to various adjacent objects leading to wear on the label and lower perceived value from a customer.

Provided herein is a novel structure for a label wrapper that addresses many of the aforementioned issues and provides an improved mode of attachment.

According to one aspect, an assembly for a label wrapper is provided having a support structure defining a receiving space. The receiving space includes opposing sidewalls and a bottom wall. First and second resilient members are positioned on two opposing sides of the receiving space. The first and second resilient members are at least partially vertically aligned with one another. Third and fourth resilient members are respectively positioned between the first and second resilient members and the bottom wall. The third and fourth resilient members are also at least partially vertically aligned with one another. A first flexible sheet is disposed over the first resilient member and along a side portion of the third resilient member. A second flexible sheet is disposed over the second resilient member and along a side portion of the fourth resilient member.

In some forms, the first and second flexible sheets are configured to support a label having an adhesive material on a first side thereof and the first and second resilient members are configured to press a first segment of the first side of the label against a second segment of the first side of the label after the label at least partially surrounds an elongated object.

In some forms, the assembly also includes a fifth resilient member positioned between the third resilient member and the bottom wall and a sixth resilient member positioned between the fourth resilient member and the bottom wall. The fifth and sixth resilient members are at least partially vertically aligned with one another on opposing sides of the receiving space.

In some forms, the support structure includes first and second brackets each including a first portion and an offset second portion. The first bracket is operably coupled with the first and third resilient members and the second bracket is operably coupled with the second and fourth resilient members.

In some forms, the assembly also includes a first brace positioned on an opposing side of the first bracket from the first or third resilient member and a second brace positioned on an opposing side of the second bracket from the second or fourth resilient member.

In some forms, a bottom portion of the first brace includes a locator projecting therefrom that is configured to interact with a locating hole defined by a bottom portion of the second brace.

In some forms, a first hem is retained by a tab on the first bracket and a second hem positioned within a void defined by the first bracket. The first hem is configured to selectively retain a first end portion of the first flexible sheet. The second hem is configured to selectively retain a second, opposing end portion of the first flexible sheet.

In some forms, a middle portion of the first flexible sheet is wrapped about a retaining pin. The retaining pin allows the first flexible sheet to be a single sheet that extends over a top portion and a bottom portion of the first resilient member, around the retaining pin, along a top portion of the third resilient member, and along a side portion of the fifth resilient member.

In some forms, the third and fourth resilient members each define a chamfered edge.

In some forms, the first and second resilient members are formed from a first material having a first density and the fifth and sixth members are formed from a second material having a second density. The second density is greater than the first density. Thus, in some instances, when the label is to be attached to a wire having a smaller diameter, the wire and label may be positioned between the fifth and sixth resilient members to provide additional compression for full adhesion.

According to another aspect, an assembly for a label wrapper includes a support structure defining a receiving space. First and second resilient members are positioned on two opposing sides of the receiving space and extending towards one another. A first flexible sheet is disposed over the first resilient member. A second flexible sheet is disposed over the second resilient member.

In some forms, third and fourth resilient members are respectively positioned between the first and second resilient members and a bottom wall of the receiving space. The third and fourth resilient members are at least partially vertically aligned with one another.

In some forms, a fifth resilient member is positioned between the first and third resilient members. A sixth resilient member is positioned between the second and fourth resilient members. The fifth and sixth resilient members are at least partially vertically aligned with one another on opposing sides of the receiving space.

In some forms, the first and second resilient members define a first channel therebetween, the third and fourth resilient members define a second channel therebetween, and the fifth and sixth resilient members define a third channel therebetween. The first, second, and third channels are vertically aligned with one another.

In some forms, the first and second flexible sheets each extend within the first, second, and third channels.

According to still yet another aspect, a method of attaching a label to a wire that includes positioning said label above first and second abutting resilient members. The label has an adhesive material on a first side thereof. The method also includes positioning the wire on an opposing side of the label from the first and second resilient members. The method further includes sliding the wire between the first and second resilient members. The first and second resilient members press a first segment of the first side of the label against a second segment of the first side of the label. Lastly, the method includes rotating the first and second resilient members relative to the wire.

In some forms, the method may further include the step of sliding the wire between third and fourth resilient members.

In some forms, the sliding the wire between the first and second resilient members step includes positioning the wire between first and second flexible sheets. The first flexible sheet extends between the label and the first resilient member and the second flexible sheet extends between the label and the second resilient member.

In some forms, the rotating the first and second resilient members relative to the wire step includes rotating the first and second resilient members in a first direction relative to the wire followed by a rotation in a second, opposing direction.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description, discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the invention," "embodiments", or "invention" do not require that all embodiments of the method, system or apparatus include the discussed feature, advantage or mode of operation.

Terms indicating relative position such as "above," "below," "upper," "lower," "rear," "front," and so forth are used for purposes of illustration only, unless otherwise noted and are made with reference to the orientation of the drawings. It should be understood that these terms are not generally meant to indicate a preferred orientation when such an orientation is not inherently or explicitly required.

Reference will be made throughout to applications of embodiments disclosed herein that adhere a label to a wire and wire bundles. Such references are for purposes of illustration and are not intended to limit the claimed invention to such applications. Rather, any elongated object may be used in conjunction with the label applicator described herein.

Figure 1:
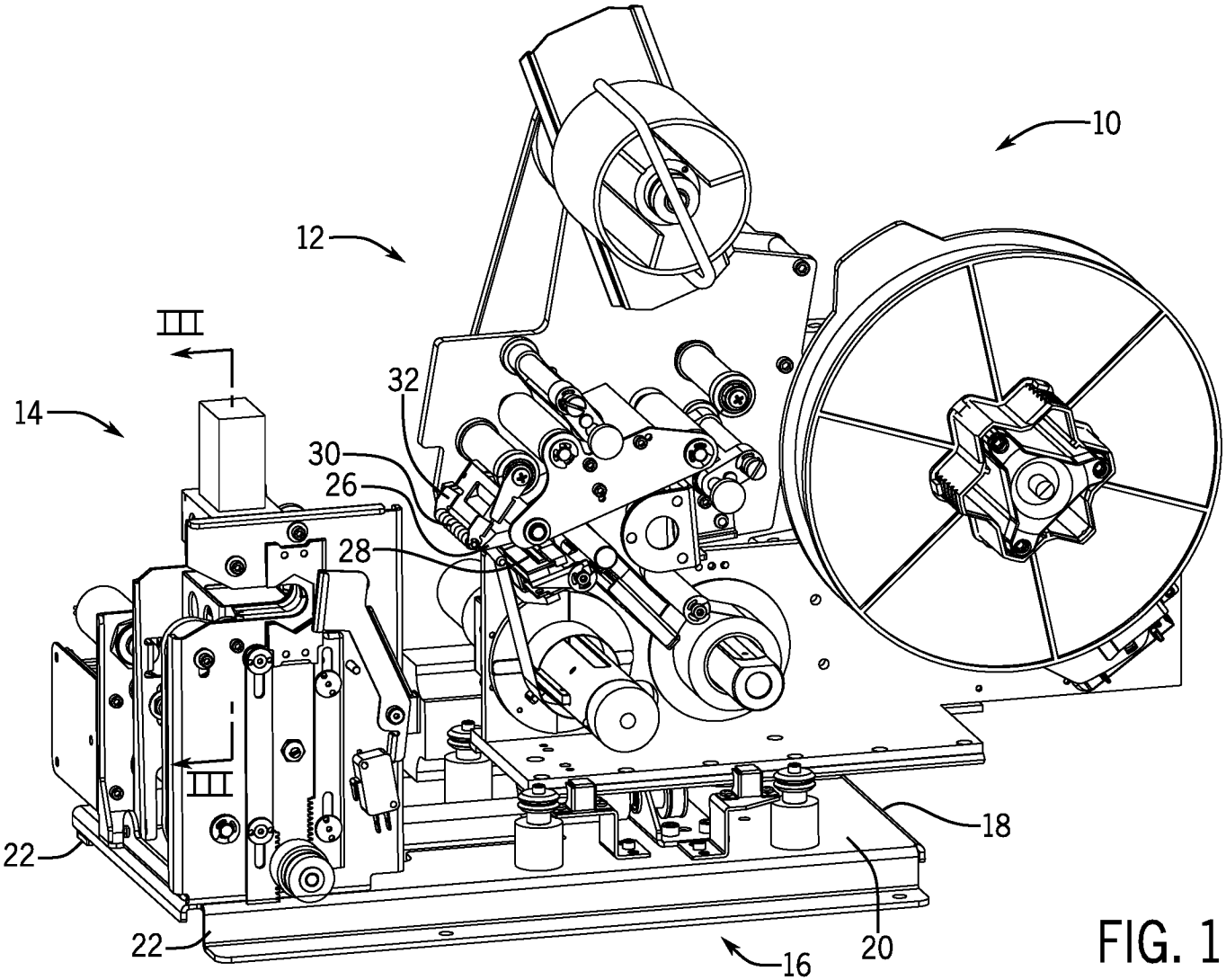
FIG. 1 is a front perspective view an example embodiment of a label applicator having a label applicator for applying flag labels to elongated objects.
Figure 2:
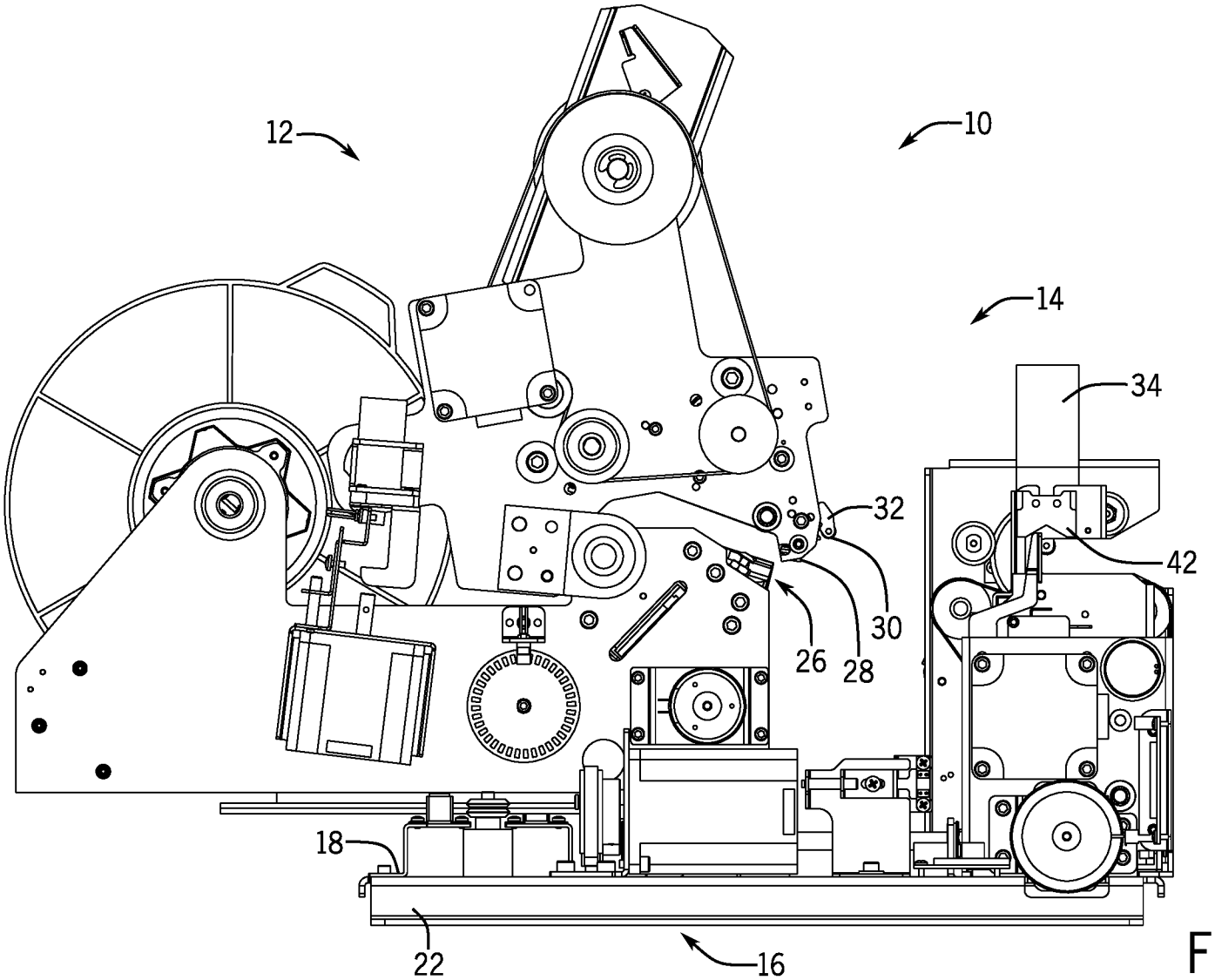
FIG. 2 is a rear plan view of the label applicator of FIG. 1.
Figure 3:
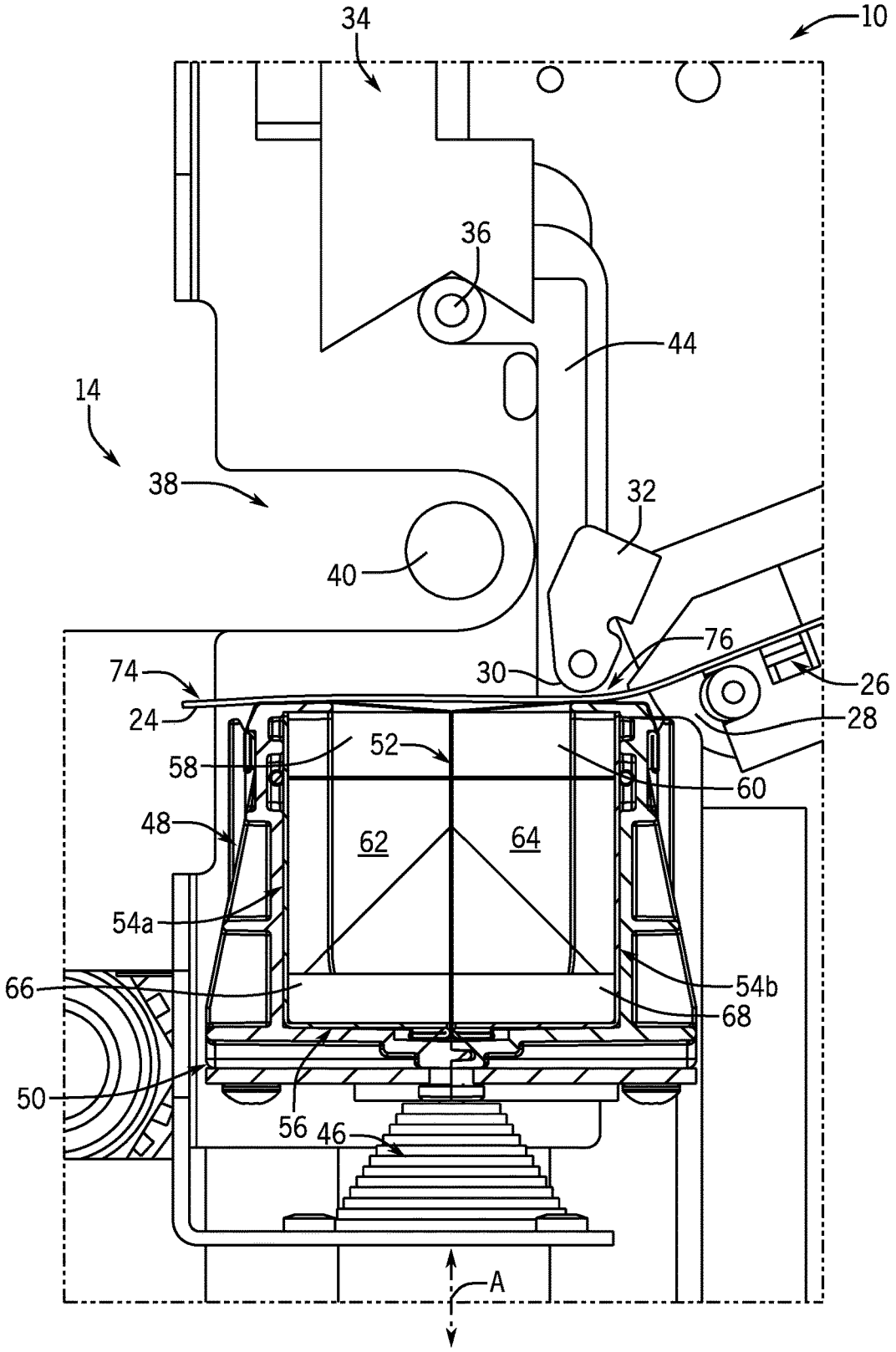
FIG. 3 is a cross-sectional view of the label applicator of FIG. 1 having an attachment assembly taken along the line III-III of FIG. 1.

Looking first at FIGS. 1-3, a label applicator 10 includes a printer 12 and a label wrapper 14 mounted on a base assembly 16. A controller electrically connected to both the printer 12 and the label wrapper 14 integrates the operation of the printer 12 and label wrapper 14 to print a label and wrap the printed label onto an elongated object, such as a wire. The controller includes any combination of software and/or processing circuitry suitable for controlling various components of the label applicator 10 described herein including without limitation processors, microcontrollers, application-specific integrated circuits, programmable gate arrays, and any other digital and/or analog components, as well as combinations of the foregoing, along with inputs and outputs for transceiving control signals, drive signals, power signals, sensor signals, and so forth. All such computing devices and environments are intended to fall within the meaning of the term "controller" or "processor" as used herein unless a different meaning is explicitly provided or otherwise clear from the context.

The base assembly 16 provides support and stability for the label applicator 10, and can slidably mount the printer 12 relative to the label wrapper 14. In some embodiments, the base assembly 16 includes a base 18 having a top wall 20 supported by a pair of longitudinal legs 22. In some examples, the top wall 20 and legs 22 are formed from a single sheet of a rigid material, such as steel, aluminum, plastic, and the like. Although a base 18 may be formed from a single sheet of material, the base 18 can be assembled from one or more components secured together by screws, bolts and nuts, welding, adhesives, and so on.

As best shown in FIG. 3, the printer 12 is configured to print indicia onto label 24 and dispenses the printed label 24 into the label wrapper 14. In some embodiments, the printer 12 is a thermal transfer printer having an upper assembly pivotally fixed to a lower assembly. In various embodiments, the printer 12 can be any printer known in the art, such as an ink jet printer, laser printer, impact printer, and the like.

The printer 12 includes a print head assembly 26 that prints indicia onto the label 24. A peel plate 28 is mounted forward of a platen roller and defines a dispensing edge. The dispensing edge forms a corner for peeling the label 24 from the substrate once the printing is complete. The peel plate 28 with the dispensing edge can ensure consistent dispensing of the label 24 with minimal tension on the substrate to eliminate feed problems caused by excessive substrate tension.

A label deflector 30 guides the label 24 detaching from the substrate into the label wrapper 14 and is rotatably supported between a pair of end brackets 32 above the peel plate 28. The label deflector 30 deflects the label 24 to prevent the label 24 from reattaching onto the substrate and to ensure that the label 24 is dispensed in a generally predefined position within the label wrapper 14.

With continued reference to FIG. 3, a striker 34 is mounted within the label wrapper 14. The striker 34 contacts a striker roller 36 forming part of the label wrapper 14. The striker 34 urges the striker roller 36 downwardly which clears an opening 38 from an attachment assembly 48 for insertion of a wire 40 being wrapped with the label 24. A locking assembly 42 (FIG. 2) may clamp onto the wire 40 being wrapped to tension the wire 40.

The striker roller 36 is contacted by the striker 34 to move a slider 44 in a vertical direction against the urging of a spring 46 away from the opening 38 to provide space for inserting a wire 40 into the opening 38. Once the wire 40 is inserted, the spring 46 urges the attachment assembly 48 upwardly along an extension axis A to place the wire 40 within the attachment assembly 48. Although a spring 46 biasing the attachment assembly 48 upwardly is illustrated, any biasing mechanism can be used, such as an elastomeric material, leaf spring, a motor, a pneumatic device, or the like. Additional information regarding the various components of a label applicator 10 is disclosed in U.S. Pat. No. 7,178,572 to Schanke et al., entitled "LABEL WRAPPER BLOCK ASSEMBLY," issued Feb. 20, 2007, the entire disclosure of which is incorporated herein by reference.

Figure 4:
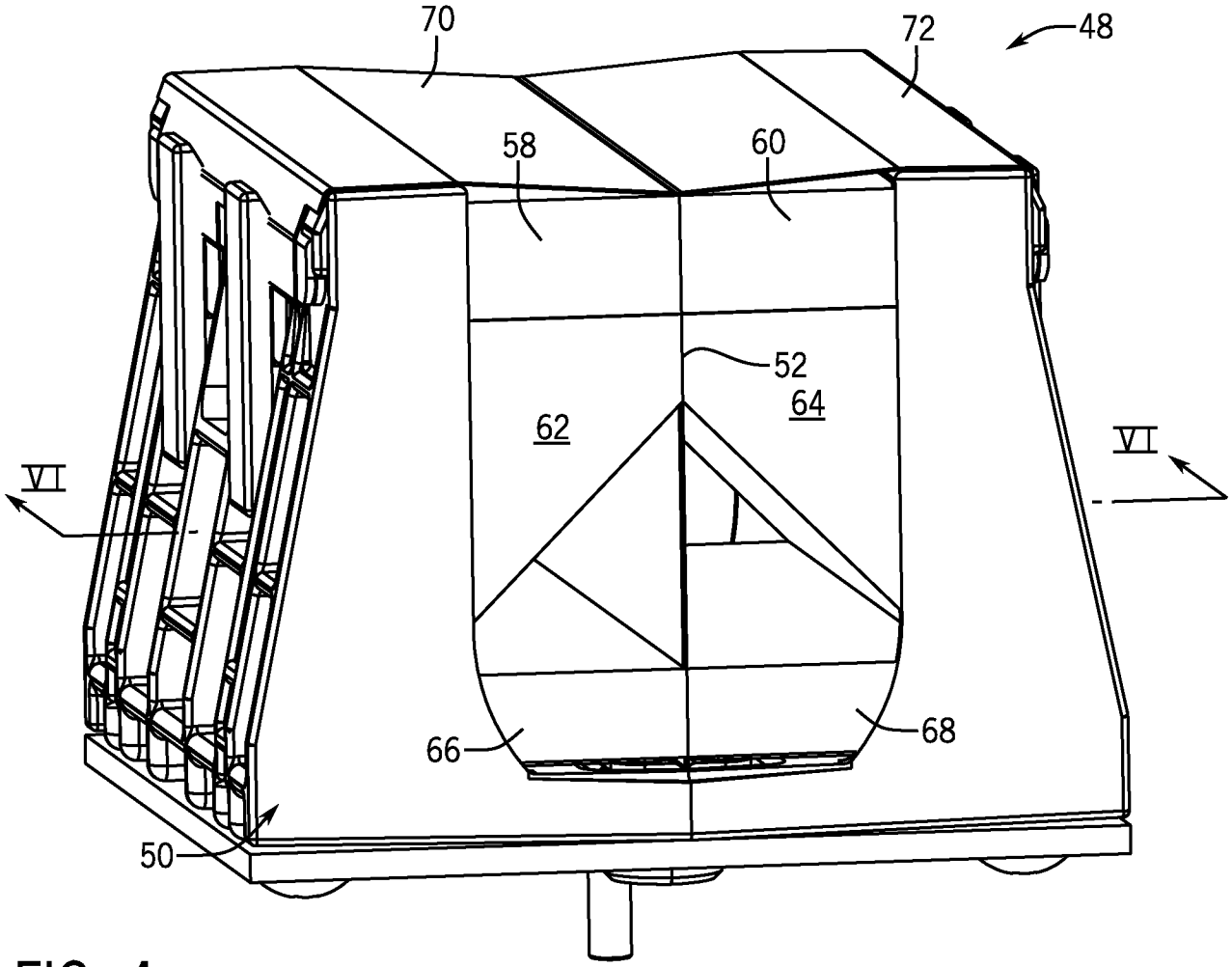
FIG. 4 is a front perspective view of the attachment assembly.

With reference to FIGS. 3 and 4, the attachment assembly 48 is coupled to the slider 44 and biased upwardly toward the striker 34. The attachment assembly 48 can include a support structure 50 that defines a receiving space 52. The receiving space 52 can be defined by opposing sidewalls 54*a*, 54*b* and a bottom wall 56. First and second resilient members 58, 60 are positioned on two opposing sides of the receiving space 52. Third and fourth resilient members 62, 64 can be respectively positioned between the first and second resilient members 58, 60 and the bottom wall 56. Likewise, in some embodiments, fifth and sixth resilient members 66, 68 may be respectively positioned between the third and fourth resilient members 62, 64 and the bottom wall 56.

A first flexible sheet 70 can be disposed over the first resilient member 58 and along a side portion of the third resilient member 62. A second flexible sheet 72 can be disposed over the second resilient member 60 and along a side portion of the fourth resilient member 64. The first and second sheets 70, 72, in conjunction with the resilient members 58, 60, 62, 64, 66, 68, may apply pressure to a wire 40 and a label 24 that is inserted into the attachment assembly 48 for attaching the label 24 to the wire 40 and/or to itself. The first and second flexible sheets 70, 72 can serve as a low-friction surface onto which the label 24 may be placed. The one or more flexible sheets may also reduce friction between the attachment assembly 48 and the wire 40/label 24 when the attachment assembly 48 is linearly and/or rotationally moving relative to the wire 40, which may improve the end quality of the attached label 24. Additionally, the one or more flexible sheets 70, 72 may protect the resilient members 58, 60, 62, 64, 66, 68 from wear and tear.

Figure 10:
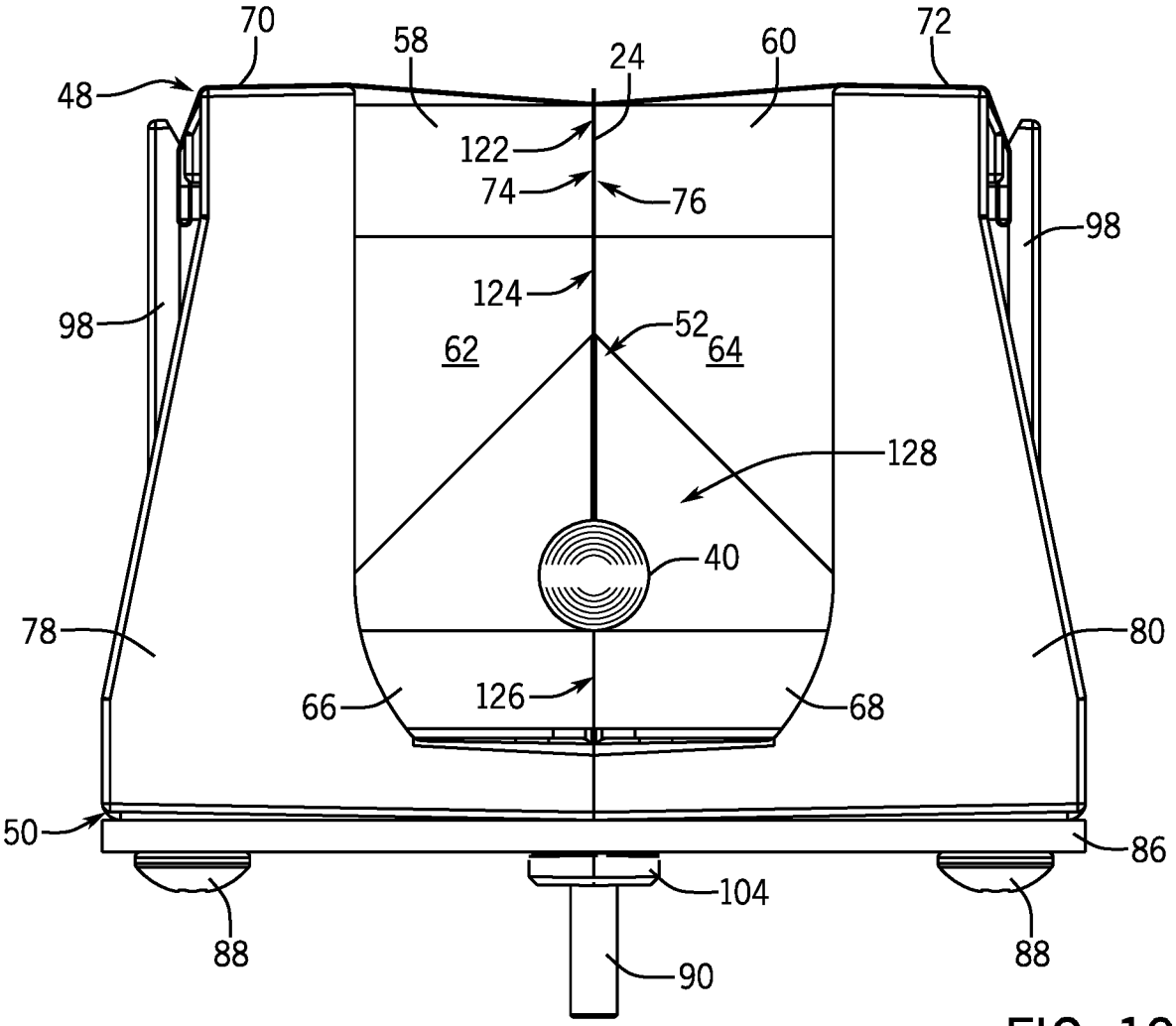
FIG. 10 is a front side view of the wire and the label positioned within the attachment assembly thereby adhering the label to the wire and to itself to form a flag label extending from the wire.

As illustrated in FIG. 3, the label 24 may be positioned on the first and/or second sheets 70, 72. In some instances, the label 24 is configured to fold around the wire 40 and have first and second opposing end segments 74, 76 that couple with one another remotely from the wire 40 thereby forming a flag label 24 when the attachment assembly 48 is moved from a first position in which the wire 40 is separated from the attachment assembly 48, as generally illustrated in FIG. 3, to a second position in which the wire 40 is disposed within a receiving space 52 defined by the attachment assembly 48, as generally illustrated in FIG. 10.

Figure 5:
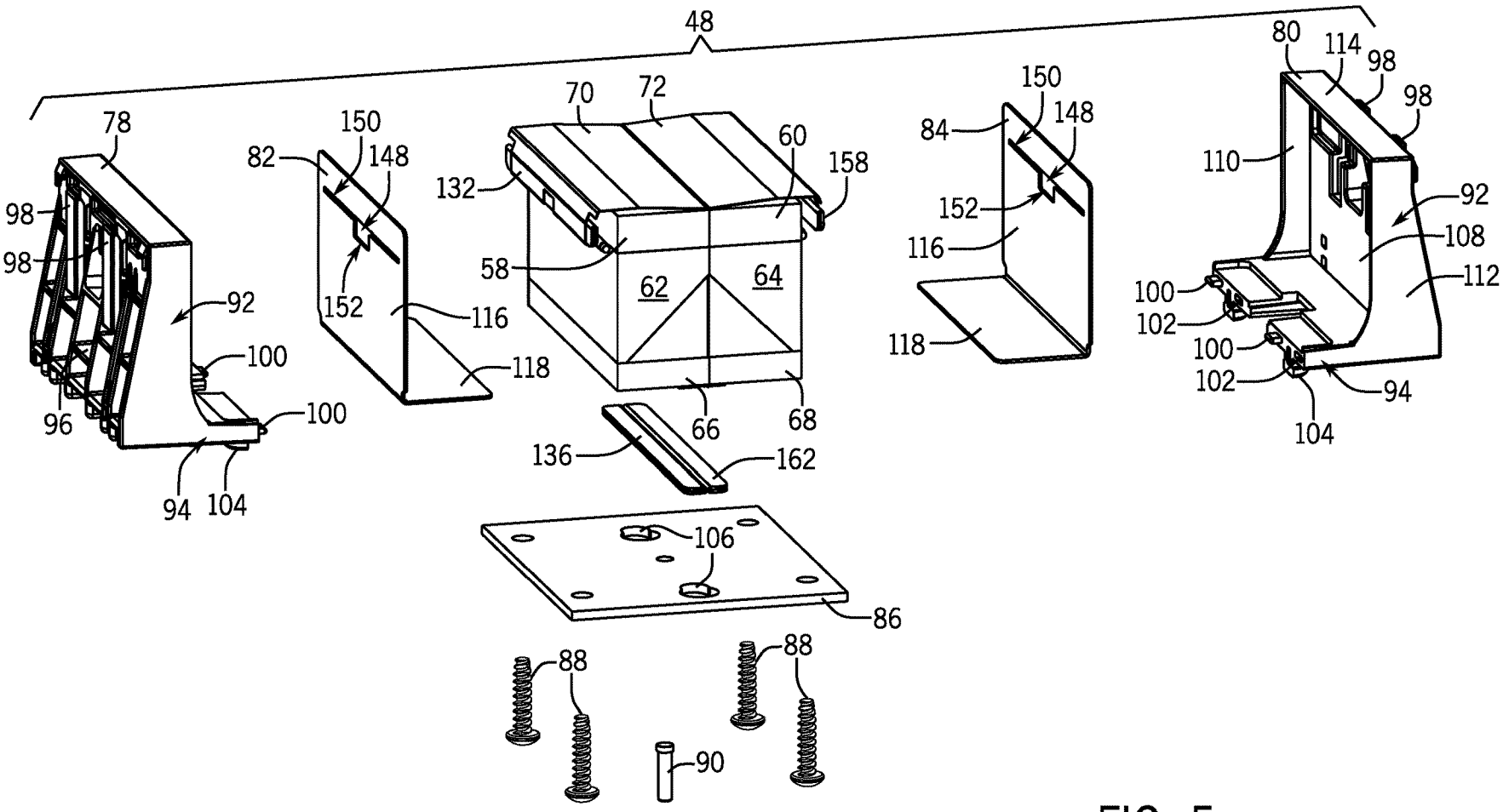
FIG. 5 is an exploded perspective view of the attachment assembly.

Referring now to FIG. 5, the support structure 50 of the attachment assembly 48 can include one or more braces 78, 80 and/or brackets 82, 84. In some examples, such as the embodiment illustrated in FIG. 5, the support structure 50 includes a support plate 86. The first and second braces 78, 80 are releasably fixed to the support plate 86 through one or more fasteners 88 positioned through fastener holes within the support plate 86 and inserted into the first and second braces 78, 80. The support plate 86 may also support a spring rod 90 for operably coupling with the spring 46.

As illustrated, the first and second braces 78, 80 each include a side portion 92 and an offset bottom portion 94. Each side portion 92 can include a rib structure 96 and one or more retainment tabs 98. The rib structure 96 and/or the retainment tabs 98 may be integrally formed with various other portions of the first and second braces 78, 80 or later attached thereto. In some examples, the first and second braces 78, 80 may be formed from a polymeric and/or elastomeric material. However, any other practicable material may be used in conjunction with or in lieu of the polymeric or elastomeric material.

To assist in alignment of the first and second braces 78, 80, locators 100 and/or voids 102 may be formed within the first and second braces 78, 80. When a locator 100 on the first or second brace 78, 80 is positioned within the locator void 102 defined by the other of the first or second brace 78, 80, the first and second braces 78, 80 may be in an aligned relationship. Once aligned, the first and second braces 78, 80 may also form alignment protrusions 104 that can be positioned within alignment spaces 102 defined by the support plate 86. Once the alignment protrusions 104 are placed within the alignment spaces 102, the first and second braces 78, 80 can be attached to the support plate 86 through the usage of the one or more fasteners 88. It will be appreciated that the support structure 50 may include any number of braces 78, 80 having any alignment assemblies.

As illustrated in FIG. 5, the first and second braces 78, 80, in combination, may define the receiving space 52. For example, the bottom portion 94 of the first and second braces 78, 80 may include a base section 108. First and second lateral walls 110, 112 extend from each base section 108. A connecting wall 114 couples the first and second lateral walls 110, 112 and likewise extend outwardly from the base section 108 of each of the first and second braces 78, 80.

Figure 6:
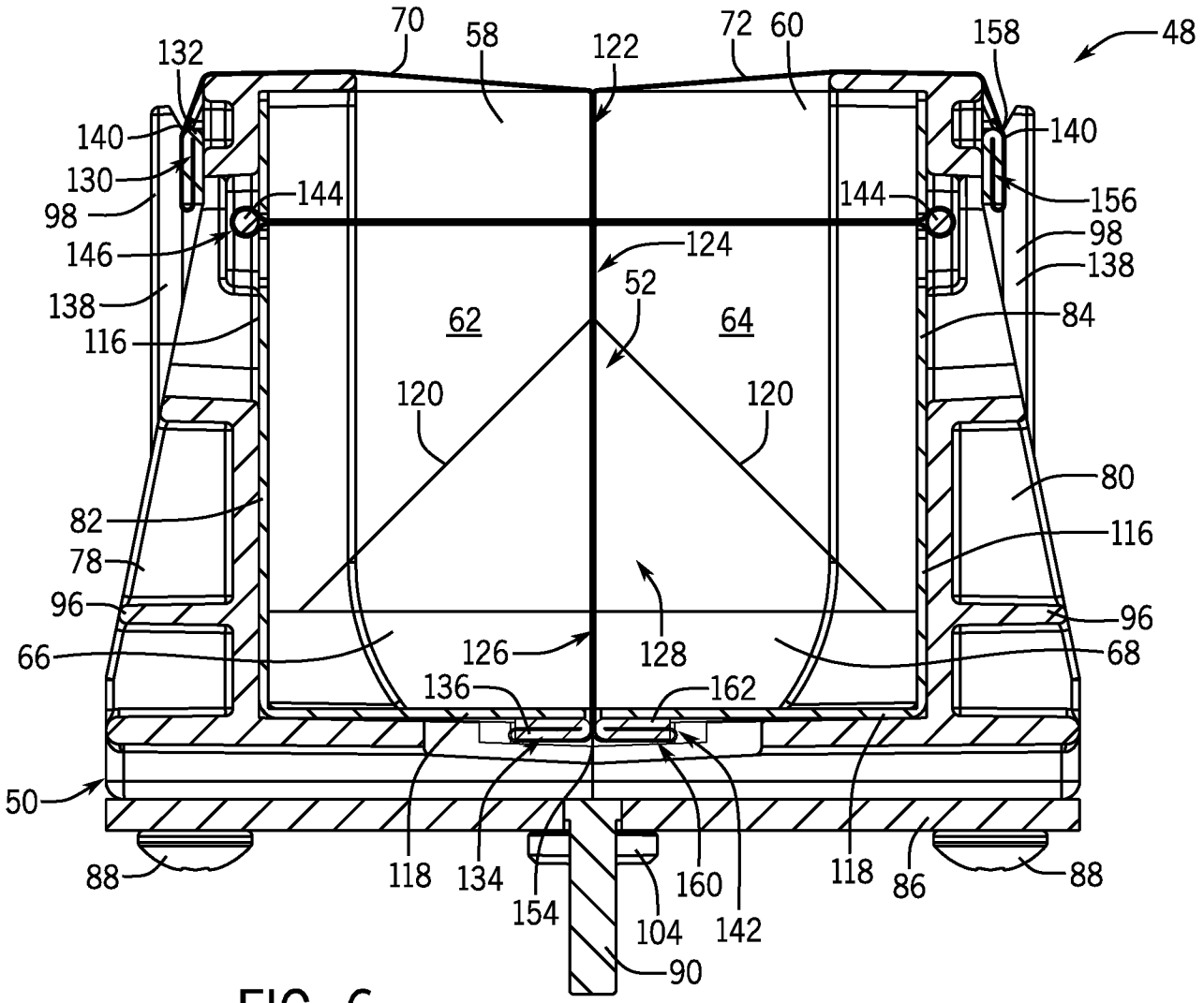
FIG. 6 is a cross-sectional view of the attachment assembly taken along the line VI-VI of FIG. 4.
Figure 7:
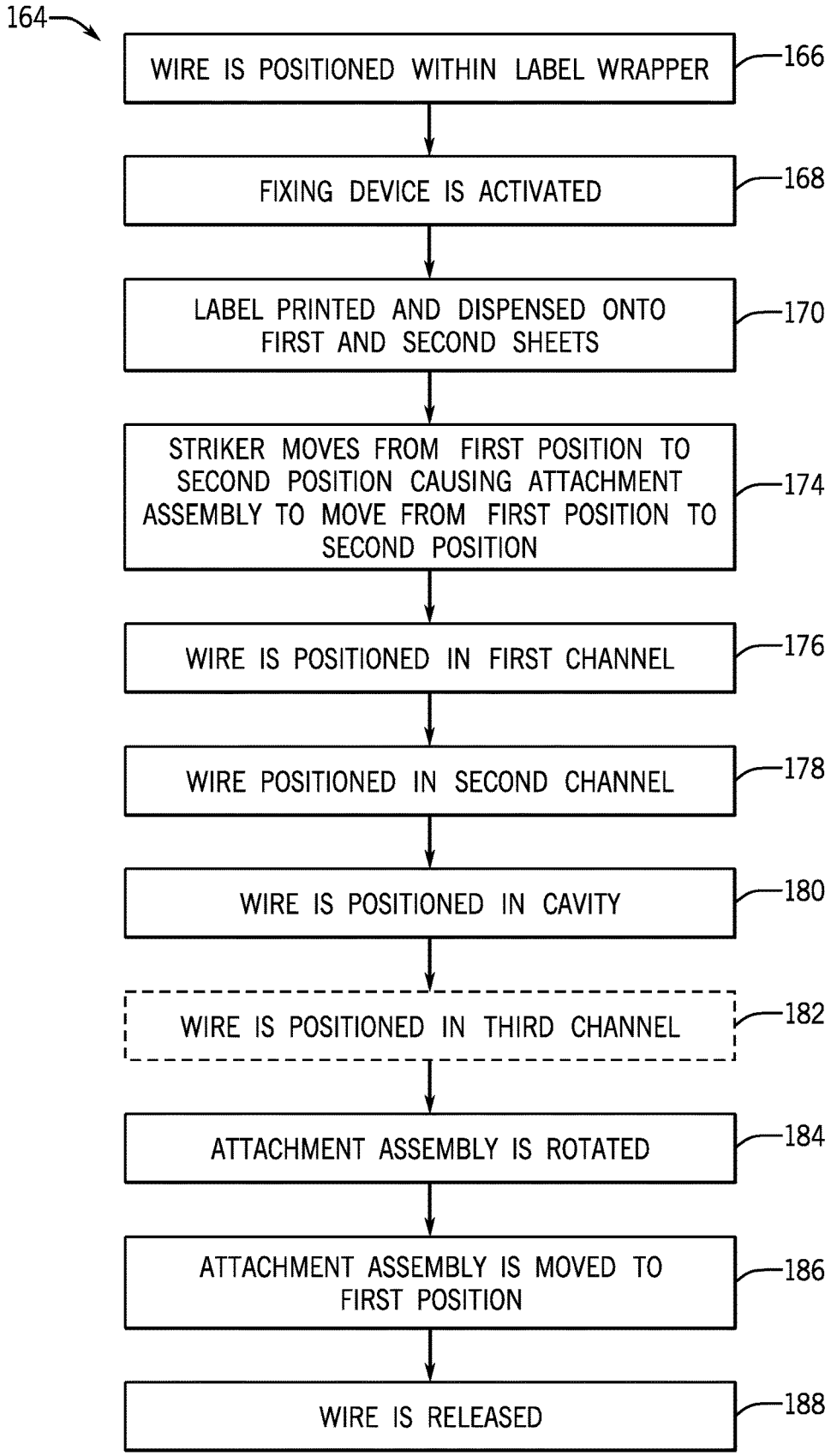
FIG. 7 is a flow chart illustrating a method for attaching a flag label to a wire.

Referring to FIGS. 5 and 6, the first and second brackets 82, 84 may be positioned within the receiving space 52 defined by the support structure 50. In some instances, the first and second brackets 82, 84 each include a first portion 116 and an offset second portion 118. The first and second lateral walls 110, 112, along with the connecting walls 114, of the first and second braces 78, 80 may respectively extend further inwardly than the first portion 116 of the first and second brackets 82, 84. Accordingly, the first portion 116 of the first and second brackets 82, 84 may be housed, or have their perimeters surrounded by the first and second braces 78, 80.

As illustrated in FIG. 6, in some examples, the first resilient member 58 extends into the receiving space 52 from the first portion 116 of the first bracket 82. Likewise, the second resilient member 60 extends into the receiving space 52 from the first portion 116 of the second bracket 84. In some instances, the first and second resilient members 58, 60 may be retained in an at least partially vertically aligned position. As used herein, any two components that are "at least partially vertically aligned" both intersect a common plane that is perpendicular to the actuation axis A of the attachment assembly 48.

Likewise, the third resilient member 62 may extend from the first bracket 82 in an at least partially vertically aligned position with the fourth resilient member 64, which can extend inwardly of the second bracket 84. Similarly, a fifth resilient member 66 may extend inwardly from the first bracket 82 and/or be supported by the second portion 118 of the first bracket 82. A sixth resilient member 68 may extend inwardly from the second bracket 84 and/or be supported by the second portion 118 of the second bracket 84.

In some embodiments, the first and second resilient members 58, 60 may have a substantially rectangular cross section. In some embodiments, the second and third resilient members 62, 64 may each include a chamfered surface 120 on an inward portion. The fifth resilient member 66 may be positioned on an opposing side of the third resilient member 62 from the first resilient member 58 and may extend along the second portion 118 of the first bracket 82. Likewise, the sixth resilient member 68 may be positioned on an opposing side of the fourth resilient member 64 from the second resilient member 60 and may extend along the second portion 118 of the second bracket 84. In some examples, the fifth and sixth resilient members 66, 68 may extend further inwardly, or towards one another, than the second portions 118 of the first and/or second brackets 82, 84.

A first channel 122 may be defined between the first and second resilient members 58, 60. Likewise, a second channel 124 may be formed between the third and fourth resilient members 62, 64 and terminate at the chamfered surfaces 120. A third channel 126 may be defined between the fifth and sixth resilient members 66, 68. A cavity 128 may be bounded by the chamfered surfaces 120 of the third and fourth resilient members 62, 64 and the top surfaces of the fifth and sixth resilient members 66, 68.

As a wire 40 is inserted into the attachment assembly 48, the wire 40 initially passes through the first channel 122. Next, as the attachment assembly 48 continues to move along the extension axis A (FIG. 3), the wire 40 may be disposed within the second channel 124. After the second channel 124, the wire 40 continues to be positioned within the cavity 128. Next, in instances when the wire 40 has a diameter that is below a predefined diameter, the wire 40 enters into the third channel 126. However, when the wire 40 has a diameter that is greater than the predefined diameter, the wire 40 is maintained in the cavity 128.

Each of the six resilient members 58, 60, 62, 64, 66, 68 may be formed from any practicable material capable of elastic deformation. For instance, in some embodiments, each of the six resilient members 58, 60, 62, 64, 66, 68 may be at least partially formed from an open or closed cell foam material. This material may be elastically compressible and rebound towards and to its original shape. In some examples, the first and second resilient members 58, 60 may be formed of a first material having a first density. The third and fourth resilient members 62, 64 may be formed of a second material having a second density. The fifth and sixth resilient members 66, 68 may be formed of a material having a third density. In various embodiments, the first and second densities may be substantially similar and lower than the third density. In other embodiments, one or more of the six resilient members 58, 60, 62, 64, 66, 68 may have a flexible shell that retains a fluid therein. In such instances, the first, second, third, and fourth resilient members 58, 60, 62, 64 may have a fluid with a lower viscosity than the fifth and sixth resilient members 66, 68.

Each of the six resilient members 58, 60, 62, 64, 66, 68 may be retained in a defined position through the usage of an adhesive material and/or through the usage of one or more fasteners. In seem instances, one or more of the six resilient members 58, 60, 62, 64, 66, 68 may be selectively retained by the first or second sheet 70, 72 or integrally formed with any component of the attachment assembly 48 for maintaining the resilient members 58, 60, 62, 64, 66, 68 in a desired position.

Referring back to FIGS. 5 and 6, the first flexible sheet 70 may have a first end portion 130 retained within a first hem 132 and a second end portion 134 retained in a second hem 136. The first hem 132 may be positioned on an opposing side of the first brace 78 from the first resilient member 58 and retained against the first brace 78 by the retainment tabs 98. In some instances, the retainment tabs 98 may each include an elongated arm 138 and retainment feature 140, such as a lip, for maintaining the first hem 132 in a predefined position. The second hem 136 may be positioned on an opposing side of the first brace 78 from the fifth resilient member 66 and within a void 142 defined by the first and second braces 78, 80.

In various embodiments, the first flexible sheet 70 may be routed along various portions of the first flexible sheet 70 and may extend from the first hem 132 over a top portion of the first brace 78 and a top portion of the first resilient member 58. The first flexible sheet 70 may then extend through the first channel 122 and between the first and third resilient members 58, 62 and/or along a bottom portion of the first resilient member 58.

In some examples, a retaining pin 144 may maintain an intermediate portion 146 of the first flexible sheet 70 between the first and second end portions 130, 134. In the example illustrated in FIG. 6, the retaining pin 144 is positioned on an opposing side of the first bracket 82 from the first resilient member 58. The first flexible sheet 70 is positioned through a hole 148 defined by the first bracket 82 (see e.g., FIG. 5), wrapped around the retaining pin 144, and returns through the hole 148. As illustrated in FIG. 5, the hole 148 may include an upper portion 150 having a first width and a lower portion 152 having a second width that is less than the first width.

The first flexible sheet 70 may then extend from the retaining pin 144 to a position over a top portion and along an interior side of the third resilient member 62. Next, the first flexible sheet 70 may extend along a side portion of the fifth resilient member 58, through a gap 154 between the first and second brackets 82, 84 and in into the void 142 defined by the first brace 78. In some examples, the second hem 136 may be retained in compression between the first brace 78 and the first bracket 82.

Likewise, the second flexible sheet 72 may have a first end portion 156 retained within a third hem 158 and a second end portion 160 retained in a fourth hem 162. The third hem 158 may be positioned on an opposing side of the second brace 80 from the second resilient member 60 and retained against the second brace 80 by the retainment tabs 98. The fourth hem 162 may be positioned on an opposing side of the second brace 80 from the sixth resilient member 68 and within the void 142 defined by the first and second braces 78, 80. The first, second, third, and fourth hems 132, 136, 158, 162 may each be formed as any type of fastening device. For example, the hems may be configured as a metallic component that compressively retains the first or second sheet 70, 72. Additionally or alternatively, the hems may be configured as a threaded connection between the fabric and the support structure 50 and/or any other fastening device.

The second flexible sheet 72 and may extend from the third hem 158 over a top portion of the second brace 80 and a top portion of the second resilient member 60. The second flexible sheet 72 may then extend through the first channel 122 and between the second and fourth resilient members 60, 64 and/or along a bottom portion of the second resilient member 60.

As illustrated in FIG. 6, a retaining pin 144 is positioned on an opposing side of the second bracket 84 from the second resilient member 60. The second flexible sheet 72 is positioned through a hole 148 defined by the second bracket 84, wrapped around the retaining pin 144, and returns through the hole 148. Like the hole 148 in the first bracket 82, the hole 148 may include an upper portion 150 having a first width and a lower portion 152 having a second width that is less than the first width.

The second flexible sheet 72 may then extend from the retaining pin 144 to a position over a top portion and along an interior side of the fourth resilient member 64. Next, the second flexible sheet 72 may extend along a side portion of the sixth resilient member 68, through the gap 154 between the first and second brackets 82, 84 and in into the void 142 defined by the first and second braces 78, 80. In some examples, the fourth hem 162 may be retained in compression between the second brace 80 and the second bracket 84. In various embodiments, the first and second sheets 70, 72 may each be comprised of or include a non-stick fabric, such as a Teflon coated or impregnated fibers, silicon coated or impregnated fabric, and the like, which provides a non-stick surface.

While sheets have been described above and are found in the illustrated embodiment, it should be appreciated that those sheets might be eliminated from the design if the resilient members have adequate surface properties themselves. For example, the resilient members may have low friction surfaces that permit the passage of the elongated object and label through them without intermediate sticking.

Figure 8:
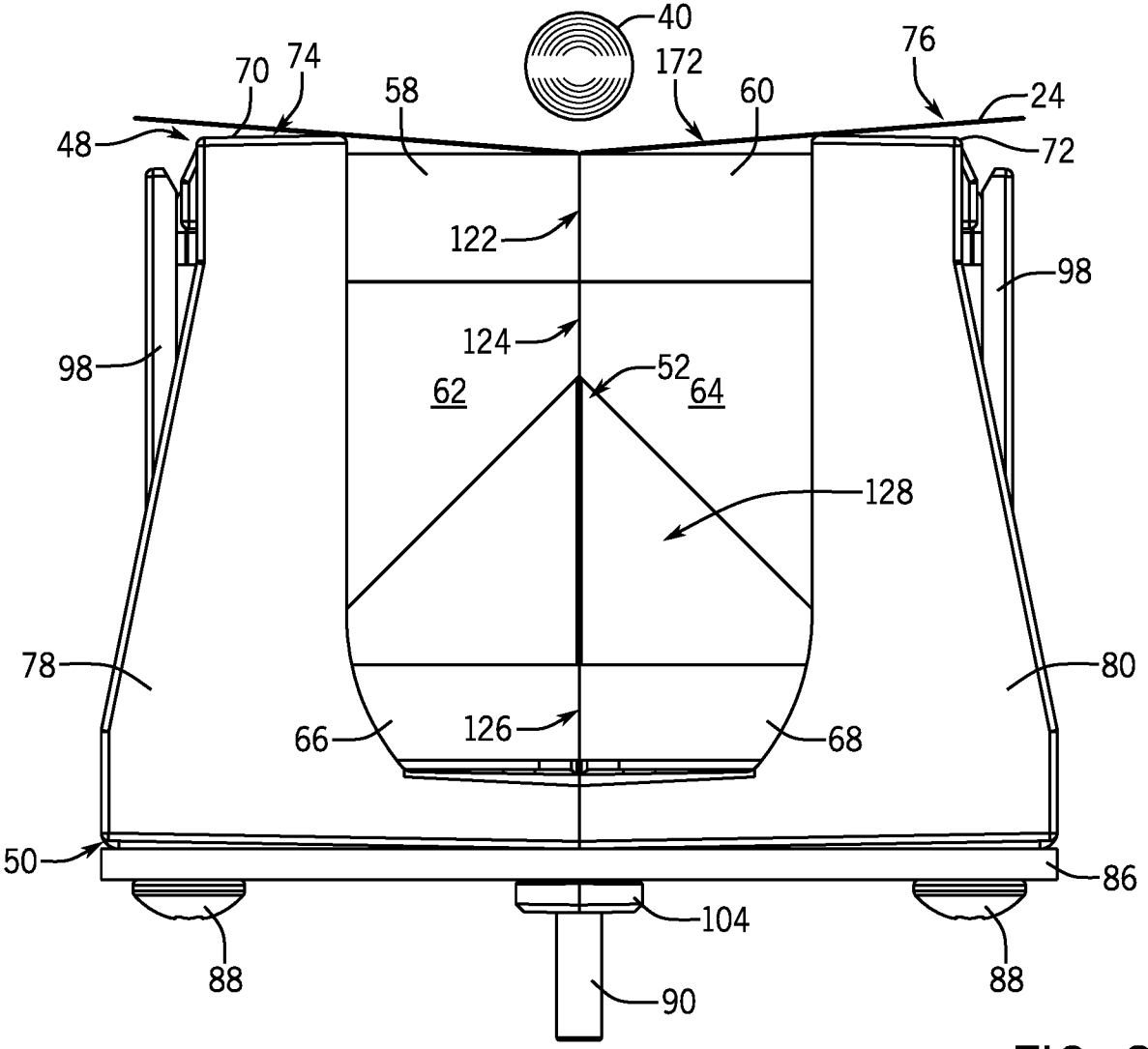
FIG. 8 is a front side view of the attachment assembly supporting a label and a wire positioned on an opposing side of the label from the attachment assembly.

Referring to FIGS. 7-10, a method 164 for placing a flag label 24 on a wire 40 can begin at step 166, where a wire 40 is positioned within an opening 38 of a label wrapper 14. In response to insertion of the wire 40 into the opening 38 formed in the label wrapper 14, at step 168, a fixing device is actuated to retain the wire 40 in a predefined position. Once the wire 40 is secured in the label wrapper 14 (or before securement of the wire 40), at step 170, the printer 12 prints the label 24 and dispenses the label 24 onto the first and second flexible sheets 70, 72, as illustrated in FIG. 8. The label 24 can be dispensed such that a surface of the label 24 having an adhesive material 172 thereon faces the wire 40.

Figure 9:
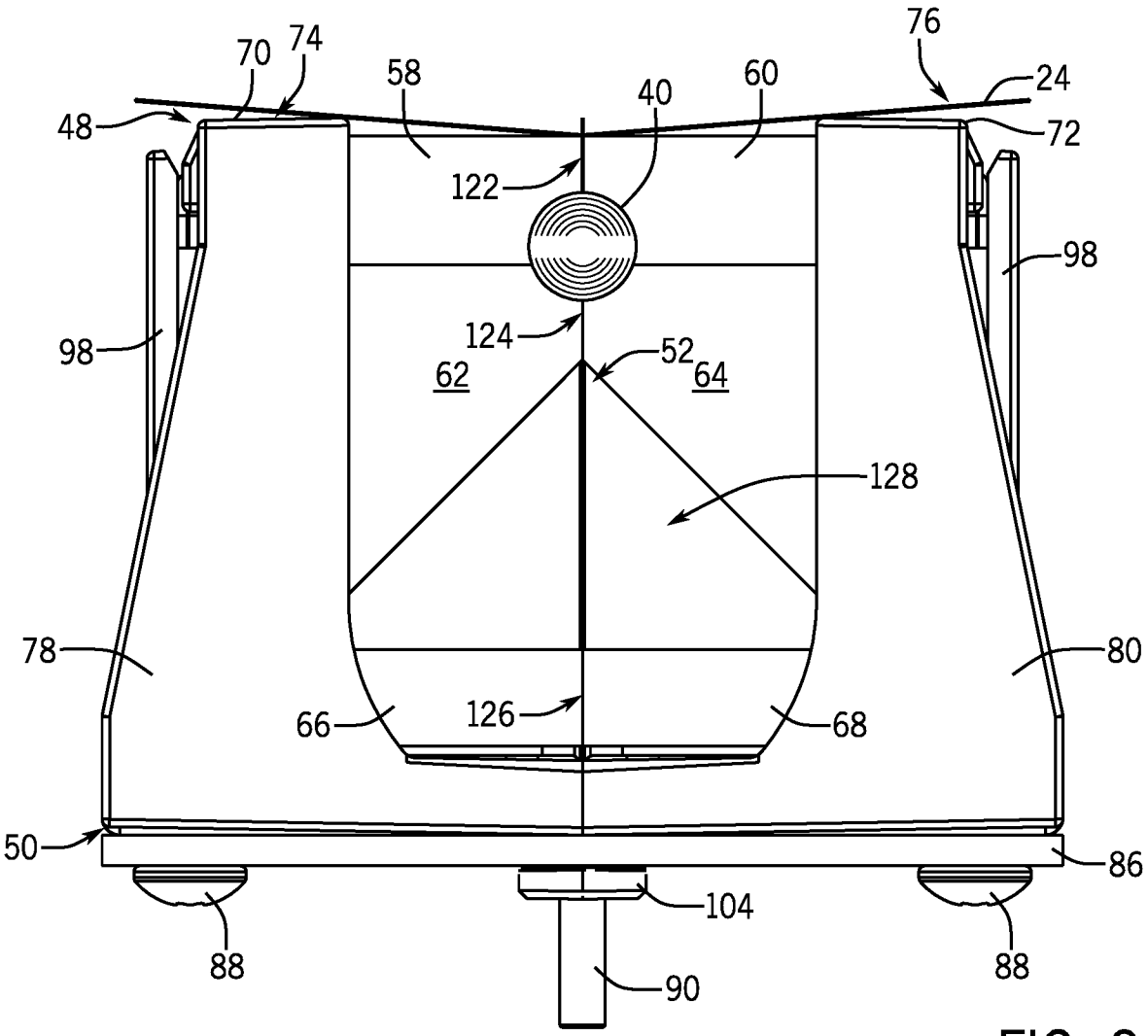
FIG. 9 is a front side view of the wire and the label disposed within a first channel of the attachment assembly.

Next, at step 174, the controller sends a signal to move the striker 34 upwards from a first position to a second position. As the striker 34 moves upward, the attachment assembly 48 also moves upward due to the force of the spring 46 (FIG. 3) such that the wire 40 is inserted into the first channel 122, at step 176, as generally illustrated in FIG. 9. In this position, the first and second resilient members 66, 68, in conjunction with the first and second sheets 70, 72, may press against the label 24 causing the label 24 to at least partially surround the wire 40. In addition, the first and second resilient members 58, 60, in conjunction with the first and second sheets 70, 72, may press a first segment 74 of the first side of the label 24 against a second segment 76 of the first side of the label 24 thereby forming a flag extending from the wire 40.

Next, at step 178, the wire 40 and the label 24 enter the second channel 124. At step 180, the wire 40 and the label 24 are positioned within the cavity 128 defined by the third, fourth, fifth, and sixth resilient members 62, 64, 66, 68. While the wire 40 is positioned within the cavity 128, the first and second flexible sheets 70, 72 apply pressure to the label 24 and the wire 40 to further adhere the label 24 to the wire 40 and adhere the first and second segments 74, 76 of the label 24 to one another. The first and second flexible sheets 70, 72 may provide a substantially uniform pressure on the label 24 being applied to the wire 40 regardless of the size of the wire 40 and the label 24.

In some instances, such as when a wire 40 is less than a predefined diameter, at step 182, the wire 40 may continue into the third channel 126. As provided herein, the fifth and sixth resilient members 66, 68 may be formed from a material having a higher density than the remaining resilient members 58, 60, 62, 64 such that the fifth and sixth resilient members 66, 68 may apply more pressure to the label 24 and wire 40 than the first and second resilient members 58, 60.

Once the label 24 has been adhered to a portion of the wire 40 by insertion into one or more of the cavities of the attachment assembly 48, at step 184, the attachment assembly 48 may rotate relative to the wire 40 to further adhere the label 24 to the wire 40. In some instances, the attachment assembly 48 may rotate in a first direction about the axis of the wire, followed by a rotation in a second, opposing direction. In some instances, the first and second rotations may be between 120 and 240 degrees. Upon completion of the rotational movement, the striker 34 may reengage the slider 44, which in turn, presses the attachment assembly 48 away from the wire 40 at step 186. Once the wire 40 and label 24 are removed from the attachment assembly 48, the wire 40 is released from the fixing device at step 188 and may be removed from the wrapper.

Thus, systems and methods including an attachment assembly configured to adhere a flag label to a wire are disclosed herein. The attachment assembly can be used to efficiently and repeatability attach a flag label to a wire, or any other elongated object. The attachment assembly can uniformly press a label against the wire to minimize bubbles and ensure that opposing sides of the label are generally aligned with one another.

The attachment assembly provided herein may include an array of resilient members having varying geometric shapes and densities such that a wide range of wires and labels may be used with a single assembly. The variability of the attachment assembly may further increase the efficiency of attaching labels to wires, or other elongated objects.

In addition, the attachment assembly may include one or more flexible sheets that can serve as a low-friction surface onto which the label may be placed. The one or more flexible sheets may also reduce friction between the attachment assembly and the wire/label when the attachment assembly is linearly and/or rotationally moving relative to the wire, which may improve the end quality of the label. Additionally, the one or more flexible sheets may protect the resilient members from wear and tear.

Although specific embodiments are described above, it will be apparent to those of ordinary skill that a number of variations can be made within the scope of the disclosure. It should be understood, therefore, that the methods and apparatuses described above are only exemplary and do not limit the scope of the invention, and that various modifications could be made by those skilled in the art. To apprise the public of the scope of this invention, the following claims are made:

What is claimed is:

1. An assembly for a label wrapper, the assembly comprising:

a support structure defining a receiving space, wherein the receiving space includes opposing sidewalls and a bottom wall;

first and second resilient members positioned on two opposing sides of the receiving space, the first and second resilient members at least partially vertically aligned with one another;

third and fourth resilient members respectively positioned between the first and second resilient members and the bottom wall, the third and fourth resilient members at least partially vertically aligned with one another;

a first flexible sheet disposed over the first resilient member and along a side portion of the third resilient member;

a second flexible sheet disposed over the second resilient member and along a side portion of the fourth resilient member;

a first hem retained by a tab on a first bracket, the first hem configured to selectively retain a first end portion of the first flexible sheet; and a second hem positioned within a void defined by the first bracket and configured to selectively retain a second, opposing end portion of the first flexible sheet.

2. The assembly for a label wrapper of claim 1, wherein the first and second flexible sheets are made from non-stick fabric.

3. The assembly for a label wrapper of claim 1, wherein the first and second flexible sheets are configured to support a label having an adhesive material on a first side thereof; and wherein the first and second resilient members are configured to press a first segment of the first side of the label against a second segment of the first side of the label after the label at least partially surrounds an elongated object.

4. The assembly for a label wrapper of claim 1, further comprising:

a fifth resilient member positioned between the third resilient member and the bottom wall; and a sixth resilient member positioned between the fourth resilient member and the bottom wall, the fifth and sixth resilient members at least partially vertically aligned with one another on opposing sides of the receiving space.

5. The assembly for a label wrapper of claim 4, wherein the first and second resilient members are formed from a first material having a first density and the fifth and sixth members are formed from a second material having a second density; and wherein the second density is greater than the first density.

6. The assembly for a label wrapper of claim 1, wherein the support structure includes first and second brackets each including a first portion and an offset second portion; and wherein the first bracket is operably coupled with the first and third resilient members and the second bracket is operably coupled with the second and fourth resilient members.

7. The assembly for a label wrapper of claim 6, further comprising:

a first brace positioned on an opposing side of the first bracket from the first or third resilient member; and a second brace positioned on an opposing side of the second bracket from the second or fourth resilient member.

8. The assembly for a label wrapper of claim 7, wherein a bottom portion of the first brace includes a locator projecting therefrom that is configured to interact with a locating hole defined by a bottom portion of the second brace.

9. The assembly for a label wrapper of claim 1, wherein a middle portion of the first flexible sheet is wrapped about a retaining pin.

10. The assembly for a label wrapper of claim 9, wherein the first flexible sheet extends over a top portion and a bottom portion of the first resilient member, around the retaining pin, along a top portion of the third resilient member.

11. The assembly for a label wrapper of claim 1, wherein each of the third and fourth resilient members have a chamfered surface, which define a cavity therebetween and through which the first flexible sheet and the second flexible sheet extend.

12. The assembly for a label wrapper of claim 1, wherein the first and second resilient members are configured to rotate about an axis of a wire received within the receiving space.

13. An assembly for a label wrapper, the assembly comprising:

a support structure defining a receiving space;

first and second resilient members positioned on two opposing sides of the receiving space and extending towards one another;

a first flexible sheet made from non-stick fabric disposed over the first resilient member;

a second flexible sheet made from non-stick fabric disposed over the second resilient member; and a first hem retained by a tab on a first bracket, the first hem configured to selectively retain a first end portion of the first flexible sheet; and a second hem positioned within a void defined by the first bracket and configured to selectively retain a second, opposing end portion of the first flexible sheet.

14. The assembly for a label wrapper of claim 13, further comprising:

third and fourth resilient members respectively positioned between the first and second resilient members and a bottom wall of the receiving space, the third and fourth resilient members at least partially vertically aligned with one another and each of the third and fourth resilient members having a chamfered surface, which define a cavity therebetween and through which the first flexible sheet and the second flexible sheet extend.

15. The assembly for a label wrapper of claim 14, further comprising:

a fifth resilient member positioned between the first and third resilient members; and a sixth resilient member positioned between the second and fourth resilient members, the fifth and sixth resilient members at least partially vertically aligned with one another on opposing sides of the receiving space.

16. The assembly for a label wrapper of claim 15, wherein the first and second resilient members define a first channel therebetween, the third and fourth resilient members define a second channel therebetween, and the fifth and sixth resilient members define a third channel therebetween; and wherein the first, second, and third channels are vertically aligned with one another.

17. The assembly for a label wrapper of claim 13, wherein the first and second resilient members are configured to rotate about an axis of a wire received within the receiving space.

18. A method of attaching a label to a wire, the method comprising:

positioning said label above first and second abutting resilient members, the label having an adhesive material on a first side thereof, a first flexible sheet made from non-stick fabric extends between the label and the first resilient member, a first hem, retained by a tab on a first bracket, selectively retains a first end portion of the first flexible sheet and a second hem, positioned within a void defined by the first bracket, selectively retains a second, opposing end portion of the first flexible sheet, and a second flexible sheet made from non-stick fabric extends between the label and the second resilient member;

positioning the wire on an opposing side of the label from the first and second resilient members;

sliding the wire between the first and second resilient members and positioning the wire between the first and second flexible sheets, wherein the first and second resilient members press a first segment of the first side of the label against a second segment of the first side of the label; and rotating the first and second resilient members about an axis of the wire.

19. The method of claim 18, further comprising:

sliding the wire between third and fourth resilient members, wherein each of the third and fourth resilient members have a chamfered surface, which define a cavity therebetween, through which the first flexible sheet and the second flexible sheet extend, and in which the wire is positioned.

20. The method of claim 18, wherein the rotating the first and second resilient members about the axis of the wire step includes rotating the first and second resilient members in a first direction relative to the wire followed by a rotation in a second, opposing direction.

* * * * *